US005630903A

United States Patent [19]

Knorr et al.

[11] Patent Number: 5,630,903

[45] Date of Patent: May 20, 1997

[54] MACHINE FOR THE MANUFACTURE OF A SINGLE-FACE LINED WEB OF CORRUGATED BOARD

[75] Inventors: Andreas Knorr, Nürnberg; Josef Puff, Vohenstrauss; Reinhard Sternitzke, Kaltenbrunn; Hermann-Josef Mensing; Heribert Reich, both of Weiherhammer, all of Germany

[73] Assignee: BHS Corrugated Maschinen- und Anlagenbau GmbH, Weiherhammer, Germany

[21] Appl. No.: 490,886

[22] Filed: Jun. 15, 1995

[30] Foreign Application Priority Data

Jun. 16, 1994 [DE] Germany ..... 44 20 958.4

[51] Int. Cl.[6] ..... B31F 1/28; B30B 5/06

[52] U.S. Cl. ..... 156/472; 156/210; 156/471; 156/583.3; 156/583.5; 100/156; 100/212

[58] Field of Search ..... 156/472, 473, 156/583.5, 583.3, 210, 471; 100/151, 153, 154, 156, 212, 162 B

[56] References Cited

U.S. PATENT DOCUMENTS

| | | | |
|---|---|---|---|
| 1,770,757 | 7/1930 | Maston | 156/473 |
| 4,467,718 | 8/1984 | Held | 100/151 |
| 4,524,589 | 6/1985 | Fleissner | 100/156 |
| 4,874,454 | 10/1989 | Talalay et al. | 156/583.3 |
| 5,019,193 | 5/1991 | Aramini | 156/583.3 |
| 5,256,240 | 10/1993 | Shortt | 156/583.3 |
| 5,320,036 | 6/1994 | Krohn et al. | 100/154 |
| 5,389,183 | 2/1995 | Seki et al. | 156/472 |
| 5,463,946 | 11/1995 | Kruger et al. | 156/583.5 |

FOREIGN PATENT DOCUMENTS

| | | |
|---|---|---|
| 0024137 | 2/1981 | European Pat. Off. . |
| 0104372 | 4/1984 | European Pat. Off. . |
| 0492310 | 7/1992 | European Pat. Off. . |
| 2142591 | 2/1973 | France . |
| 315523 | 1/1991 | Japan . |
| 9117881 | 11/1991 | WIPO . |

*Primary Examiner*—Michele K. Yoder
*Attorney, Agent, or Firm*—Browdy and Neimark

[57] ABSTRACT

A machine for the manufacture of a single-face lined web of corrugated board comprises a pressing device for pressing a liner web against a paper web provided with a corrugation. This pressing device has at least one substantially stationary, open-end pressing belt, which does not move together with the web of corrugated board.

10 Claims, 4 Drawing Sheets

MACHINE FOR THE MANUFACTURE OF A SINGLE-FACE LINED WEB OF CORRUGATED BOARD

BACKGROUND OF THE INVENTION

Field of the Invention

The invention relates to a machine for the manufacture of a single-face lined web of corrugated board, comprising two fluted rollers for the production of a corrugation on a paper web, a gluing device for spreading glue on the peaks of the corrugation of the corrugated paper web, a pressing device for pressing a liner web on the peaks, provided with glue, of the corrugated paper web resting on one of the fluted rollers along a contact area, the pressing device having a pressing belt pressable against the fluted roller along a pressing area.

Background Art

A machine of the generic type is known from EP 0 492 310 A1. The webs of corrugated board made by machines of this type have a width ranging from 1.2 to 2.8 m, usually 2.5 m. There are considerable difficulties in obtaining uniform pressing by the circulating endless belt over the entire width of the paper web because the deflection roller tends to bend. Therefore, EP 0 492 310 A1 provides for a crowned design of the deflection roller so as to compensate for the bending of the deflection roller. The requirements are considerable. In addition, the pressing belt is subject to torsional effects. Further, it is extraordinarily time-consuming and expensive to replace a damaged belt. At least one deflection roller is supported in bearings, which are each slidable by means of a tensioning drive formed by a piston-cylinder drive.

EP 0 104 372 B1 teaches having a continuously circulating pressing belt pressed against the fluted roller in the zone of pressing by means of a compressed-air pad.

SUMMARY OF THE INVENTION

It is the object of the invention to improve a machine of the generic type such that the pressing of the liner web on the corrugated paper web in the zone of pressing is effected in an especially simple and reliable way.

According to the invention, this object is solved by the pressing device having at least one substantially stationary open-ended pressing belt. The at least one pressing belt is substantially stationary in the machine, i.e. it does not circulate together with the liner web. This helps save considerable constructional requirements. Due to the fact that the at least one pressing belt is substantially stationary, the tensioning devices can be made especially simple in design. Even the adjustment to different widths of the corrugated board web to be produced can be realized in a very simple way.

Further features, advantages and details of the invention will become apparent from the description of exemplary embodiments, taken in conjunction with the drawing.

DESCRIPTION OF THE PREFERRED EMBODIMENTS

Figure 1:
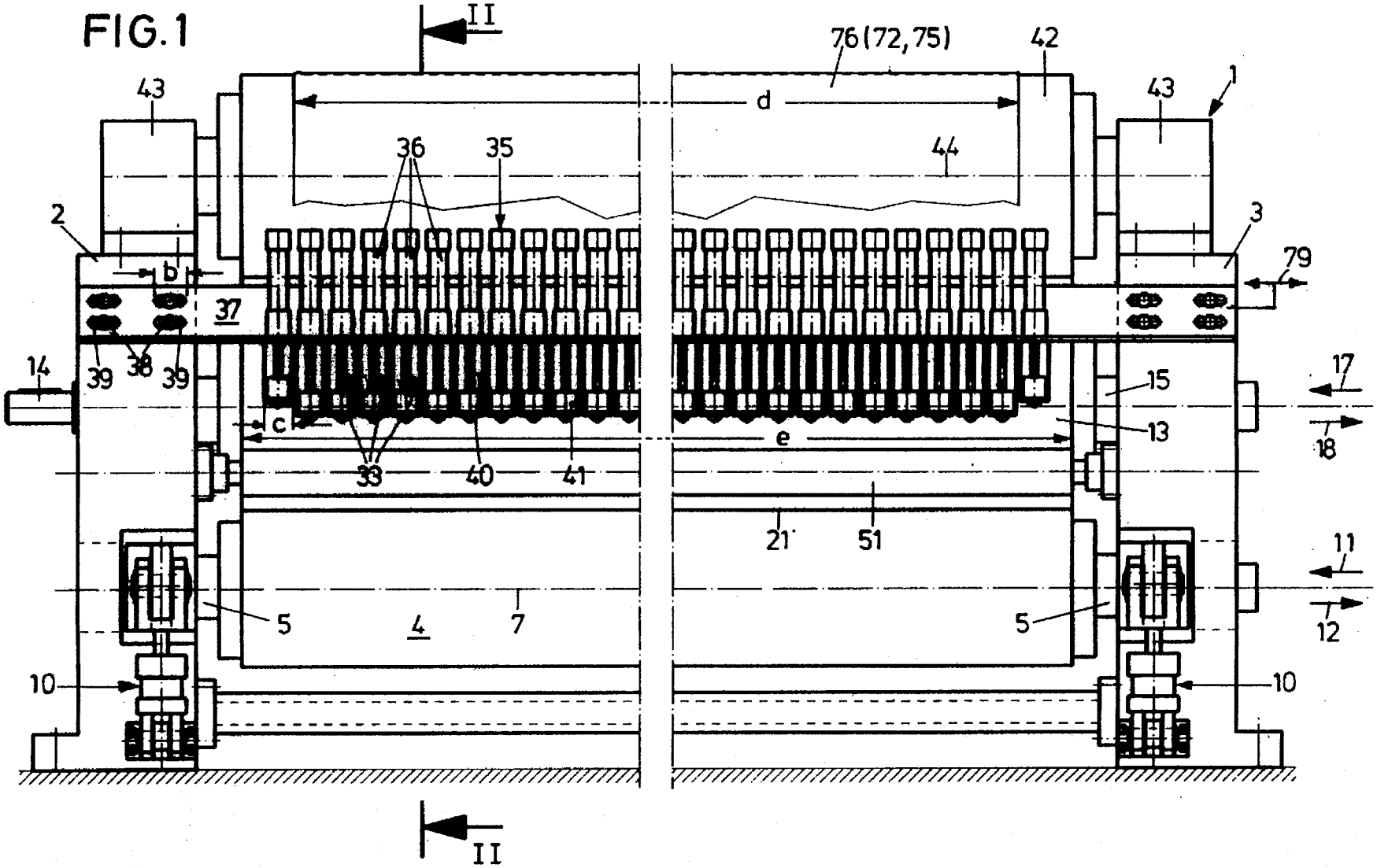
FIG. 1 is a front view of a machine according to FIG. 2 for the manufacture of a single-face lined web of corrugated board.
Figure 2:
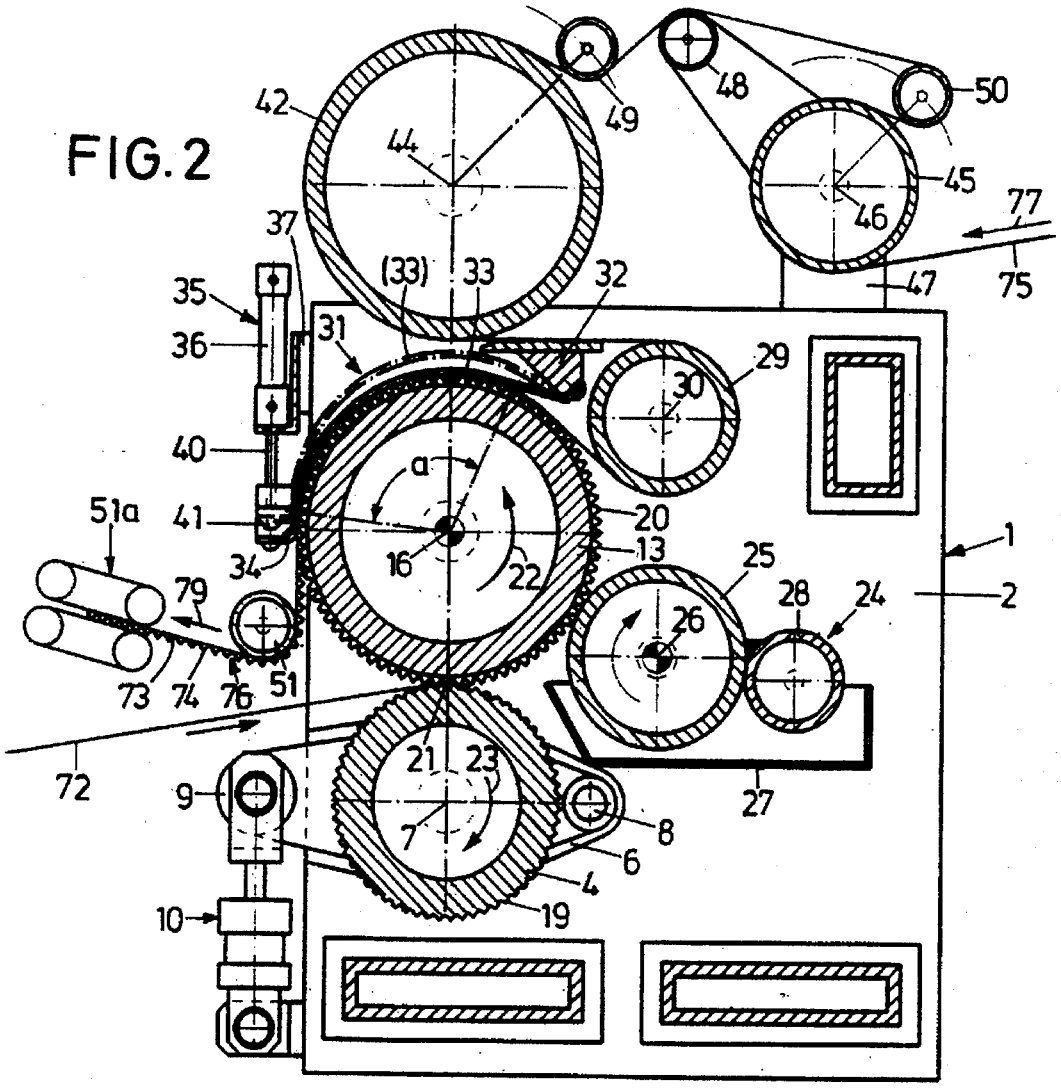
FIG. 2 is a vertical cross-section through the machine according to the section line II—II of FIG. 1.
Figure 3:
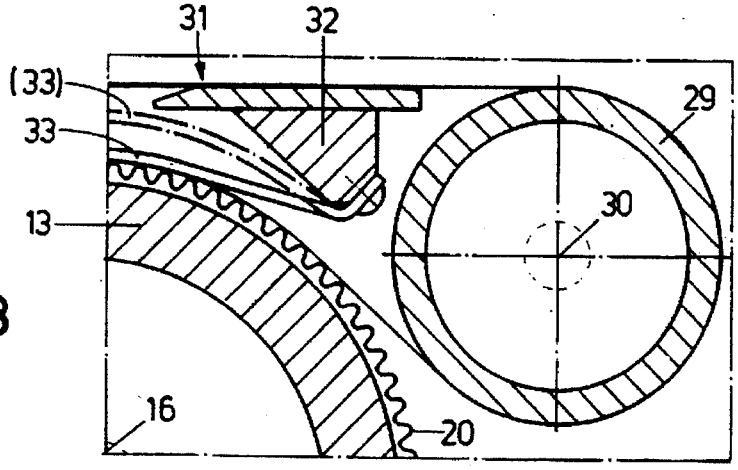
FIG. 3 is a partial section of FIG. 2 on an enlarged scale as compared with FIG. 2.

The machine of FIGS. 1 to 3 comprises a machine frame 1, which has two side walls 2, 3 parallel to and spaced apart from each other. A lower fluted roller 4 is rotatably supported by shaft journals 5 in a link 6 in the form of an articulated lever. At a distance from the axis of rotation 7 of the lower fluted roller 4, one end of the links 6 is lodged in the side walls 2 and 3 of the machine frame 1 by means of a swivel bearing 8. On their end 9 turned away from the swivel bearing 8, the links 6 are supported relative to the machine frame 1 by way of a feed and pressing drive 10 in the form of a hydraulically actuatable piston-cylinder drive. The hollow lower fluted roller 4 can be heated by steam supplied in the direction of the arrow 11; condensed moisture is discharged according to the direction arrow 12.

An upper fluted roller 13 is rotatably lodged in the side walls 2, 3 of the machine frame 1 above the lower fluted roller 4 by means of shaft journals 14, 15. The upper fluted roller 13 is driven to rotate about its axis of rotation 16 by means of a drive motor (not shown) via the shaft journal 14. The upper fluted roller 13, too, can be heated, which is indicated by a direction arrow 17 for the steam and a direction arrow 18 of the condensed moisture.

On their cylinder faces, the lower fluted roller 4 and the upper fluted roller 13 are provided with flutings 19, 20, which extend parallel to the axes of rotation 7, 16 and which mesh in the contact area 21 of the two fluted rollers 4, 13. The upper fluted roller 13 is driven in the direction of rotation 22, whereby the lower fluted roller 4 lodged to be freely rotatable is driven in the direction of rotation 23. Downstream of the contact area 21 seen in the direction of rotation 22 and 23, a gluing device 24 is disposed in the machine frame 1; the gluing device 24 has a glue spreading roller 25 to be advanced towards the fluting 20 of the upper fluted roller 13. The glue spreading roller 25 is positioned for rotation about an axis of rotation 26. It is driven by a motor (not shown). The gluing device 24 further comprises a glue basin 27, into which the glue spreading roller 25 dips to take up glue. Further, a nipper 28 is assigned to the glue spreading roller 25, the nipper 28 serving to leave only a thin film of glue on the surface of the glue spreading roller 25.

Above the glue spreading roller 25, a deflection roller 29 is lodged in the side walls 2, 3 of the machine frame 1 for free rotation about an axis of rotation 30.

A pressing device 31 is disposed above the upper fluted roller 13, comprising a belt retainer 32 disposed between the deflection roller 29 and the upper fluted roller 13 and arrested on the side walls 2, 3 of the machine frame 1. Individual pressing belts 33 arranged without joints one beside the other are fixed to this beam-type belt retainer 32;.starting from the belt retainer 32, they extend in the direction of rotation 22 of the upper fluted roller 13, and that by an angle of belt contact a of approximately 90° to 120°.

A tensioning device 35, which is formed by a hydraulically actuatable piston-cylinder drive, acts upon each end 34, opposite to the belt retainer 32, of the pressing belt 33. All cylinders 36 are disposed on a supporting beam 37, which is secured to the side walls 2, 3 by means of screws 38, which pass through oblong holes 39 provided in the supporting beam 37 and extending in the longitudinal direction of the supporting beam 37. The length b of these oblong holes 39 exceeds half the width c of a pressing belt 33. A fastening member 41, to which the free end 34 of the respective pressing belt 33 is fixed, is disposed on the free ends of the piston rod 40 of the tensioning device 35. When the piston rod 40 is extracted, the respective pressing belt 33 bears against the upper fluted roller 13, which is shown by solid lines in FIGS. 2 and 3. When the piston rod 40 is moved in, the respective pressing belt 33 is lifted off the circumference of the fluted roller 13, which is shown by dash-dotted lines in FIGS. 2 and 3.

The pressing belts 33 are of thin steel, for instance spring steel, of suitable plastics, of a steel fabric or of a ceramic-coated material. In any case it is suitable for the pressing belts 33 to be air-permeable, i.e. the steel or plastics belts are perforated.

A second preheating roller 42 is lodged in bearings 43 above the upper fluted roller 13 for rotation about an axis of rotation 44. The bearings 43 are mounted on the side walls 2, 3 of the machine frame 1. A first preheating roller 45 is arranged upstream of this second preheating roller 42; the first preheating roller 45 is lodged in bearings 47 for rotation about an axis of rotation 46, the bearings 47 also being mounted on the side walls 2, 3 of the machine frame 1. A stationary rotatable guiding roller 48 is disposed between the first preheating roller 45 and the second preheating roller 42. Further, a guiding roller 49 or 50, adjustable about the respective axis of rotation 44 or 46, is assigned to each preheating roller 42 or 45. The preheating rollers 42, 45 and the deflection roller 29 can be heated in the same way as the fluted rollers 4, 13.

In the direction of rotation 22, a guiding roller 51 and a drawing roller 51*a* are arranged downstream of the upper fluted roller 13.

Figure 4:
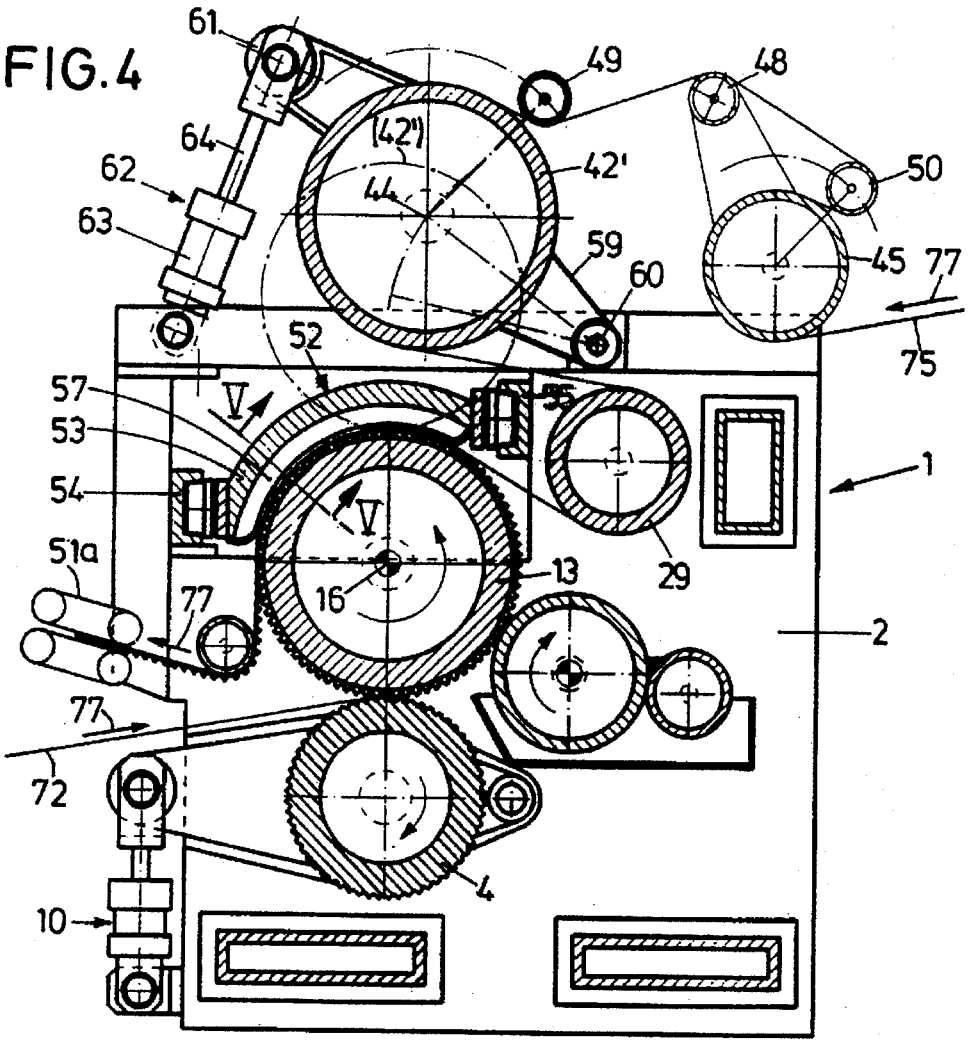
FIG. 4 is a vertical cross-section of a modified embodiment of the machine in an illustration corresponding to FIG. 2.
Figure 5:
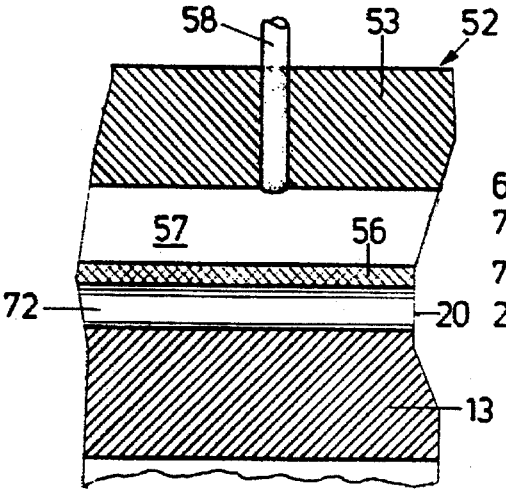
FIG. 5 is a partial cross-section through the machine according to the section line V—V of FIG. 4.

As far as the embodiment according to FIGS. 4 and 5 is identical with that according to FIGS. 1 to 3, the same reference numerals are used without a renewed description. In so far as parts of identical function, but differing construction are provided, the same reference numerals are used, however provided with a prime. In this regard, there is no need of renewed description.

In the embodiment according to FIGS. 4 and 5, a pressing device 52 is provided above the upper fluted roller 13. It has a supporting bow 53 extending approximately concentrically of the axis of rotation 16 of the upper fluted roller and reaching over the entire length of the upper fluted roller 13; this supporting bow 53 is bedded in abutments 54, 55 mounted stationarily on the machine frame 1 to be easily attachable and detachable. On the side of the supporting bow 53 facing toward the upper fluted roller 13, a pressing belt 56 of flexible material, for instance rubber or plastics or thin sheet steel or the like, is provided, an airtight pressure chamber 57 being defined between the pressing belt 56 and the partially cylindrical supporting bow 53. A pressure inlet 58 for compressed air or hydraulic fluid opens into this pressure chamber 57 through the supporting bow 53.

In the embodiment according to FIGS. 4 and 5, the second preheating roller 42' is not supported in bearings fixed to the machine frame, but in links 59 in the form of articulated levers, of which one end is supported on each side wall 2 and 3 of the machine frame 1 by means of a swivel bearing 60. The other end 61 of each link 59 is connected with the machine frame 1 by way of a feed drive 62. These feed drives 62 are hydraulically actuatable piston-cylinder drives, the cylinders 63 of which are pivotably supported on the respective side wall 2 or 3, while their piston rod 64 acts upon the end 61 of the respective link 59. When the pressing device 52 is installed, then the second preheating roller 42' is in the elevated position shown in FIG. 1, in which the piston rod 64 is extracted from the cylinder 63. It works exclusively as a preheating roller. When, however, the pressing device 52 is removed, then the second preheating roller 42' can be pivoted toward and against the upper fluted roller 13, which is shown by a dash-dotted line in FIG. 4. In this position it works as a pressing roller.

Figure 6:
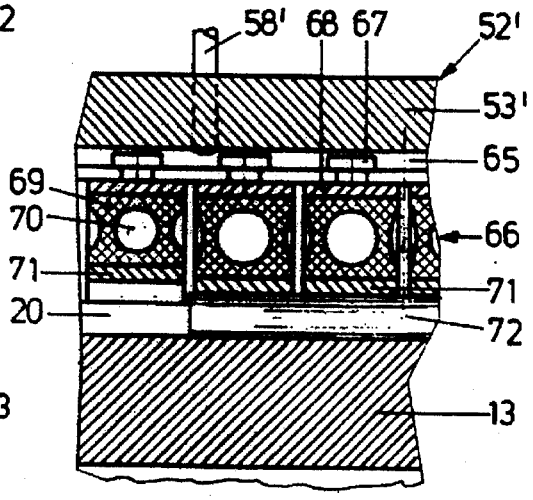
FIG. 6 is an illustration according to FIG. 5 of a modified embodiment of the machine according to FIG. 4.

FIG. 6 is an illustration of a partial section of a pressing device 52' modified as compared with FIGS. 4 and 5. It also has a supporting bow 53, which is provided with rear-recessed grooves 65 extending parallel to the axis of rotation 16. In these grooves 65, pressing segments 66 are fixed one beside the other by means of fastening pins 67 of T-shaped cross-section. The pressing segments 66 have a base plate 68 which is bent in the form of a segment of a circle and on which the fastening pins 67 are mounted. A pressure body 69, gaiter-type in cross-section, is disposed as a tensioning device on the base plate 68 and has an inner pressure chamber 70 connected to a pressure inlet 58'. A pressing belt 71 is provided on the side of the oblong pressure body 69 facing toward the upper fluted roller 13. The pressure body 69 serving as a pressing element consists of an elastic material, for instance rubber or the like. When its pressure chamber 70 is not acted upon by pressure medium, then the pressing belt 71 is located at a distance from the fluting 20 of the upper fluted roller 13 as illustrated on the left in FIG. 6. If, however, the pressure chambers 70 of the pressure bodies 69 are acted upon by pressure medium, then the pressure body 69 expands, whereby the pressing belt 71 is advanced toward the fluting 20, as outlined in the middle and on the left in FIG. 6.

The operation of the machines is as follows:

A paper web 72 enters the contact area 21 between the lower fluted roller 4 and the upper fluted roller 13 and is provided with a corrugation 73 by the flutings 19, 20. The peaks 74 of the respective corrugation 73 are provided with glue in the gluing device 24. The remaining portions of the corrugated paper web 72 are not glued. A liner web 75 consisting of paper and having the same width as the paper web 72 is guided along the first preheating roller 45, the adjustable guiding roller 50, the stationary guiding roller 48, the adjustable guiding roller 49 and the second preheating roller 42 and the deflection roller 29. Due to the fact that the deflection roller 29 is located between the second preheating roller 42 or 42', respectively, and the upper fluted roller 13, the side of the liner web 75 which rests on the second preheating roller 42 or 42' and which is heated particularly intensively by the latter takes a position in which it faces the paper web 72, i.e. the side of the liner web 75 preheated on the second preheating roller 42 or 42' comes to bear as against the glued peaks 74 of the paper web 72. In the pressing device 31 and 52 or 52', respectively, the liner web 75 is tightly pressed against the glued peaks 74 of the corrugated paper web 72. The pressing belts 33 or the pressing belt 56 or the pressing belts 71, respectively, exercise the required contact pressure on the liner web 75. Since the liner web 75 is preheated in the described way and the upper fluted roller 13 is heated, tight gluing between the liner web 75 and the corrugated paper web 72 takes place on the way along the angle of belt contact a on the upper fluted roller 13. The finished glued corrugated board web 76, which is single-face lined with a liner web 75, leaves the machine in a draw-off direction corresponding to the conveying direction of the webs 72, 75. When, in the embodiment according to FIG. 4 and 5 or 6, the pressing device 52 or 52', respectively, has been removed from the machine, then the second preheating roller 42' is pivoted toward the upper fluted roller 13 and acts as a pressing roller.

The pressing belts 33 and 71 can be triggered individually, i.e. each tensioning device 35 and, respectively, each pressure body 69 serving as a pressing element can be triggered individually. On principle, so as to avoid too high a heating of the liner web 75, the contact pressure can be controlled in dependence on the temperature of the liner web 75 running in or out. The mentioned air-permeable design of the pressing belts 33 and 71 also contributes to this. When the width d of the paper web 72 and the liner web 75 is less than the length e of the upper fluted roller 13, which is roughly outlined in FIG. 1, then the pressing belts 33 which are not needed are moved into a position of non-engagement with the fluted roller 13—shown by a dash-dotted line in FIGS. 2 and 3—in that their tensioning devices 35 are not actuated. This applies correspondingly to the pressing device 52'. The projection of pressing belts 33 and 71 from the paper web 72 and the liner web 75 can be achieved by the adjustability of the supporting beam 37 carrying the tensioning devices 35 and by corresponding adjustability of the belt retainer 32 in the direction 79 by half a width c of the pressing belts 33. Here, too, the same applies correspondingly to the pressing device 52'. In such a case the lateral projection of a pressing belt 33 and 71, respectively, from the paper web 72 and the liner web 75 is less than half the width c, if, in addition, the tensioning devices 35, 69 not needed are not actuated.

The position of the lower fluted roller 4 relative to the upper fluted roller 13 is not coercive. Also the preheating rollers 42, 42' and 45 can change their position relative to the upper fluted roller 13. Only the position of the gluing device 24 relative to the upper fluted roller 13 is given.

Figure 7:
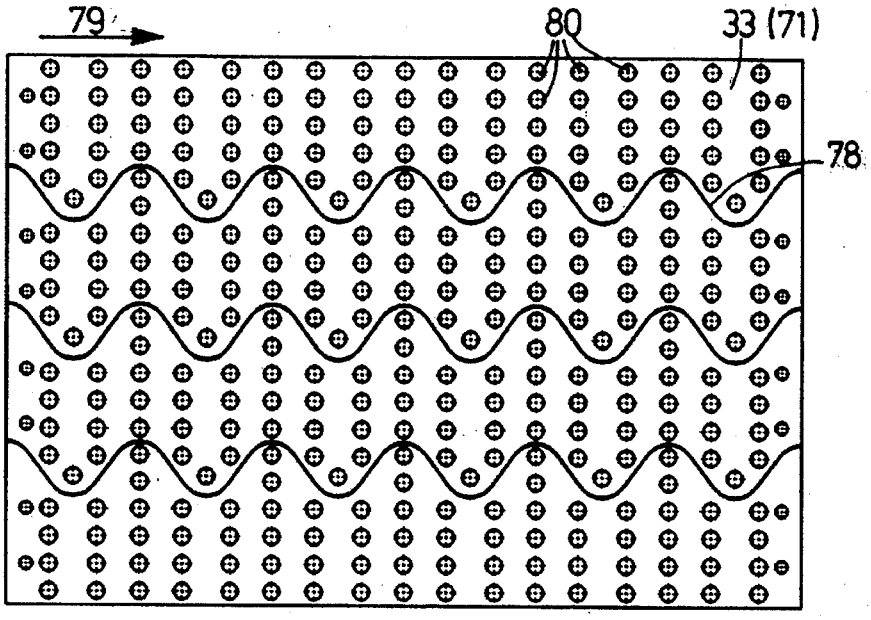
FIG. 7 is a plan view on a plurality of pressing belts.
Figure 8:
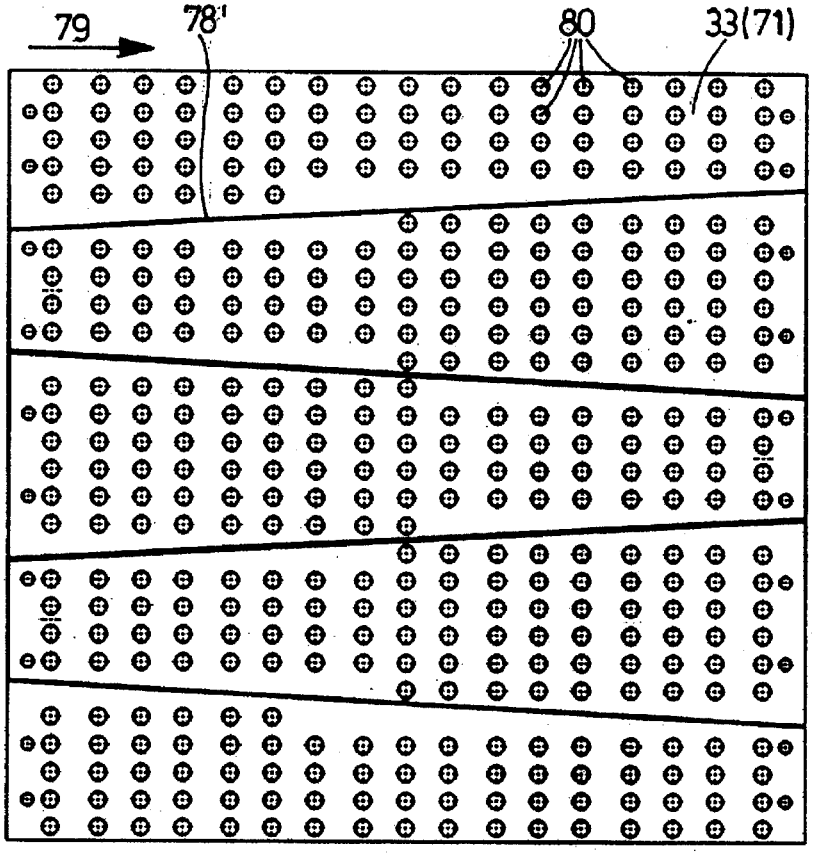
FIG. 8 is a plan view on a plurality of pressing belts modified as compared with FIG. 7.

Since the pressing belts 33 and 71, respectively, cannot be arranged entirely without joints one beside the other, there is the risk that minor ribs occur on the liner web 75 in the vicinity between two pressing belts 33 and 71. According to FIG. 7, the adjacent edges 78 of adjacent pressing belts 33 and 71 may for instance be corrugated like a sine wave to avoid this effect. In the embodiment according to FIG. 8, the edges 78' are set at a bias relative to the conveying direction 77 of the webs 72, 75. In FIGS. 7 and 8, also the pressing belts 33 and 71 are shown to have holes 80 making the respective pressing belt 33 and 71 air-permeable.

The pressing belts 33 and 71 have a width c of less than 200 mm and preferably ranging from 50 to 200 mm.

When the second preheating roller 42 is used as a pressing roller, then the liner web 75 is supplied via the first preheating roller 45, the adjustable guiding roller 50, the stationary guiding roller 48 to the first preheating roller 45 serving as the pressing roller directly above the deflection roller 29, and led into the contact area between the upper fluted roller 13 and the roller 42. In this case, too, the liner web 75 is glued to the corrugated paper web 72 between the pressing roller 42, then serving as a preheating roller, and the fluted roller 13, and moves on in the conveying direction 72 toward the drawing roller 51*a*. The deflection roller 29 is not contacted in this case.

What is claimed is:

1. A machine for the manufacture of a single-face lined web of corrugated board (76), comprising a first and a second fluted roller (4, 13) for corrugating a paper web (72), a gluing device (24) for spreading glue on peaks (74) of the corrugations (73) of the corrugated paper web (72), a pressing device (31, 52') for pressing a liner web (75) on the Blue on the peaks (74), of the corrugated paper web (72) resting on the second fluted roller (13) along a contact area, the pressing device (31, 52') having a plurality of pressing belts pressable against the second fluted roller (13) along a pressing area, wherein each of the plurality of pressing belts is stationary and open-ended rather than continuous, wherein the plurality of pressing belts (33, 71) are adjacent and disposed one beside the other over a maximal width (d) of the corrugated paper web (76), wherein contiguous edges (78, 78') of the plurality of pressing belts (33, 71) take a course deviating from a conveying direction (77) of the web of corrugated board (76).

2. A machine according to claim 1 wherein each of the plurality of pressing belts (33, 71) is provided with a single associate tensioning device (35, 69).

3. A machine according to claim 1, wherein the plurality of pressing belts (33) are fixed to a common belt retainer (32).

4. A machine according to claim 2, wherein the tensioning device (35) is formed by a linear drive acting on an end (34) of a respective pressing belt (33) of said plurality of pressing belts.

5. A machine according to claim 2 wherein the tensioning device is formed by a pressure body (69) expansible by pressure medium and extending over a substantial part of the length of the pressing belt (71).

6. A machine according to claim 2, wherein the tensioning devices (35, 69) are individually controllable.

7. A machine according to claim 2, wherein each of the plurality of pressing belts (33, 71) and the single associate tensioning device (35, 69) are displaceable and adjustable in a longitudinal direction of the fluted rollers (4, 13).

8. A machine according to claim 1, wherein the pressing belts (33, 71) are air-permeable.

9. A machine according to claim 1 wherein a width c of the pressing belts is less than 200 mm.

10. A machine according to claim 9 wherein the width c is greater than 50 mm and less than 200 mm.

* * * * *